US009637209B1

(12) United States Patent
Brown

(10) Patent No.: US 9,637,209 B1
(45) Date of Patent: May 2, 2017

(54) LIFE-SAVING JACKET WITH INTEGRATED EPIRB RADIO

(71) Applicant: Eldon Brown, Beulaville, NC (US)

(72) Inventor: Eldon Brown, Beulaville, NC (US)

( * ) Notice: Subject to any disclaimer, the term of this patent is extended or adjusted under 35 U.S.C. 154(b) by 0 days.

(21) Appl. No.: 15/144,940

(22) Filed: May 3, 2016

(51) Int. Cl.

| | |
|---|---|
| ***B63C 9/20*** | (2006.01) |
| ***B63C 9/08*** | (2006.01) |
| ***A41D 1/04*** | (2006.01) |
| ***A41D 27/20*** | (2006.01) |
| ***B63C 9/11*** | (2006.01) |
| *B63C 9/00* | (2006.01) |

(52) U.S. Cl.
CPC ..... *B63C 9/20* (2013.01); *A41D 1/04* (2013.01); *A41D 27/205* (2013.01); *B63C 9/08* (2013.01); *B63C 9/11* (2013.01); *B63C 2009/0017* (2013.01)

(58) Field of Classification Search
CPC .. B63C 9/08; B63C 9/081; B63C 9/11; B63C 9/13; B63C 9/20; B63C 9/00
USPC ..... 441/88, 89, 106, 111
See application file for complete search history.

(56) References Cited

U.S. PATENT DOCUMENTS

| | | | | |
|---|---|---|---|---|
| 3,095,568 | A | 6/1963 | Aine | |
| 3,621,501 | A * | 11/1971 | Jordan | B63C 9/20 441/89 |
| 4,903,243 | A | 2/1990 | Turner, Jr. | |
| D422,666 | S | 4/2000 | Wagner | |
| 6,220,910 | B1 | 4/2001 | Richey | |
| 6,350,168 | B1 * | 2/2002 | Kroll | B63C 9/20 441/106 |
| 6,388,617 | B1 | 5/2002 | Flood | |
| 6,439,941 | B2 * | 8/2002 | McClure | B63C 9/0005 441/89 |
| 6,545,606 | B2 | 4/2003 | Piri | |
| 7,023,338 | B1 | 4/2006 | Foth | |
| 8,514,095 | B2 | 8/2013 | Greer | |
| 9,381,982 | B1 * | 7/2016 | Sumpter | B63C 9/20 |
| 2008/0258968 | A1 | 10/2008 | Kim | |
| 2009/0167536 | A1 * | 7/2009 | Clark | B63C 9/00 340/573.4 |
| 2012/0122358 | A1 | 5/2012 | Hansbro | |
| 2014/0218217 | A1 * | 8/2014 | Calvar Anton | B63C 9/08 340/984 |

* cited by examiner

*Primary Examiner* — Lars A Olson
(74) *Attorney, Agent, or Firm* — Kyle A. Fletcher, Esq.

(57) ABSTRACT

The lifesaving jacket with integrated EPIRB radio is a personal safety device that is adapted for use by an individual. The lifesaving jacket with integrated EPIRB radio is designed to be worn as a garment during emergency situations. Should the individual wearing the garment come into the distress during the emergency situation, the individual can activate a beacon that is incorporated into the garment such that a distress message including the GPS coordinates of the garment is transmitted to the appropriate authorities indicating the need for assistance. The lifesaving jacket with integrated EPIRB radio comprises a vest, a beacon, and a pocket.

9 Claims, 4 Drawing Sheets

FIG. 4
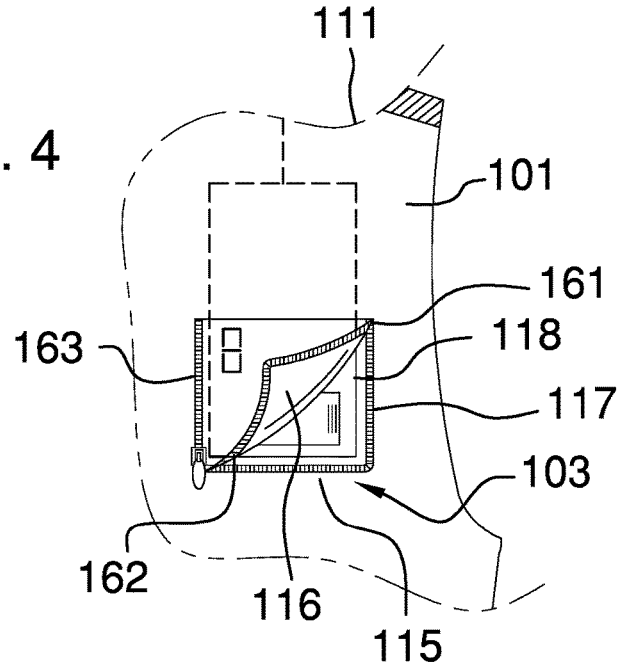
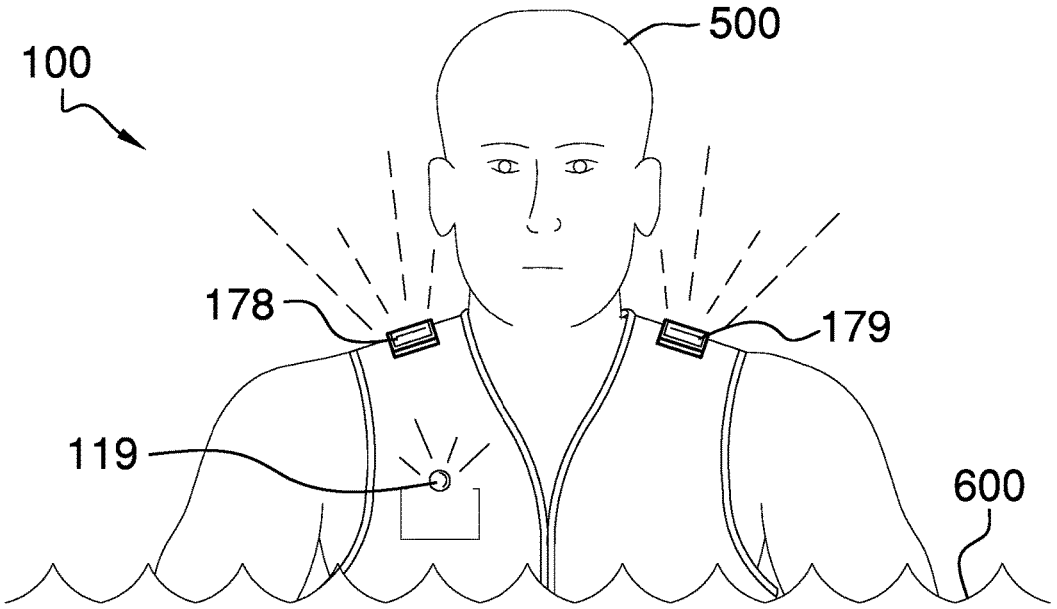
FIG. 5

LIFE-SAVING JACKET WITH INTEGRATED EPIRB RADIO

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of devices and methods for lifesaving, more specifically, a lifesaving garment with a locating beacon.

SUMMARY OF INVENTION

The lifesaving jacket with integrated EPIRB radio is a personal safety device that is adapted for use by an individual. The lifesaving jacket with integrated EPIRB radio is designed to be worn as a garment during emergency situations. Should the individual wearing the garment come into the distress during the emergency situation, the individual can activate a beacon that is incorporated into the garment such that a distress message including the GPS coordinates of the garment is transmitted to the appropriate authorities indicating the need for assistance.

These together with additional objects, features and advantages of the lifesaving jacket with integrated EPIRB radio will be readily apparent to those of ordinary skill in the art upon reading the following detailed description of the presently preferred, but nonetheless illustrative, embodiments when taken in conjunction with the accompanying drawings.

In this respect, before explaining the current embodiments of the lifesaving jacket with integrated EPIRB radio in detail, it is to be understood that the lifesaving jacket with integrated EPIRB radio is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the lifesaving jacket with integrated EPIRB radio.

It is therefore important that the claims be regarded as including such equivalent construction insofar as they do not depart from the spirit and scope of the lifesaving jacket with integrated EPIRB radio. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

FIG. 4 is a cross-sectional view of an embodiment of the disclosure cross 4-4 as shown in FIG. 2.

FIG. 5 is a view of an embodiment of the disclosure in use.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
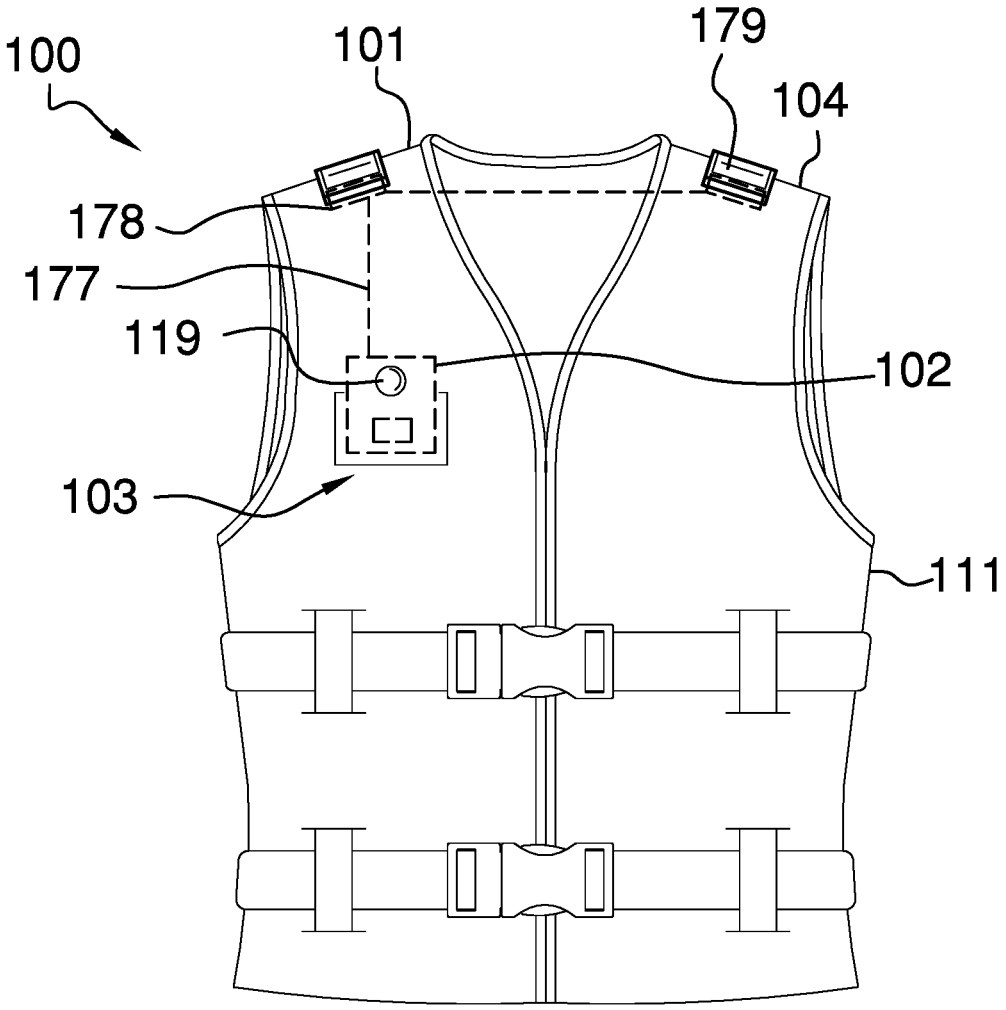
FIG. 1 is a front view of an embodiment of the disclosure.
Figure 2:
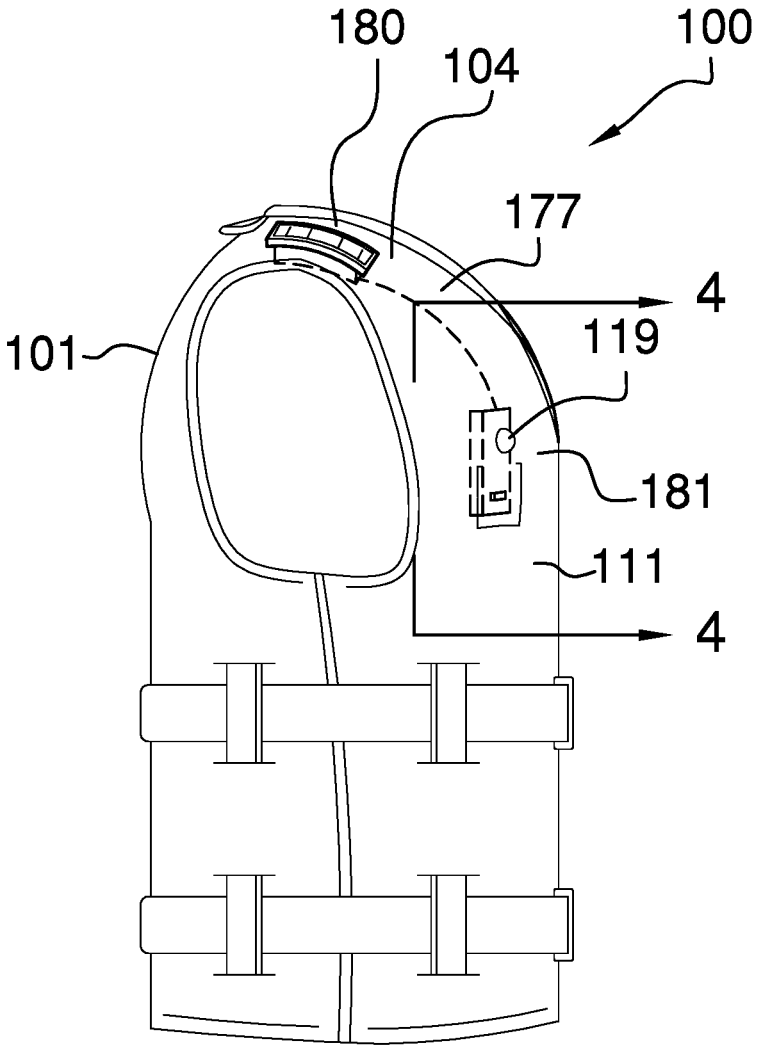
FIG. 2 is a side view of an embodiment of the disclosure.
Figure 3:
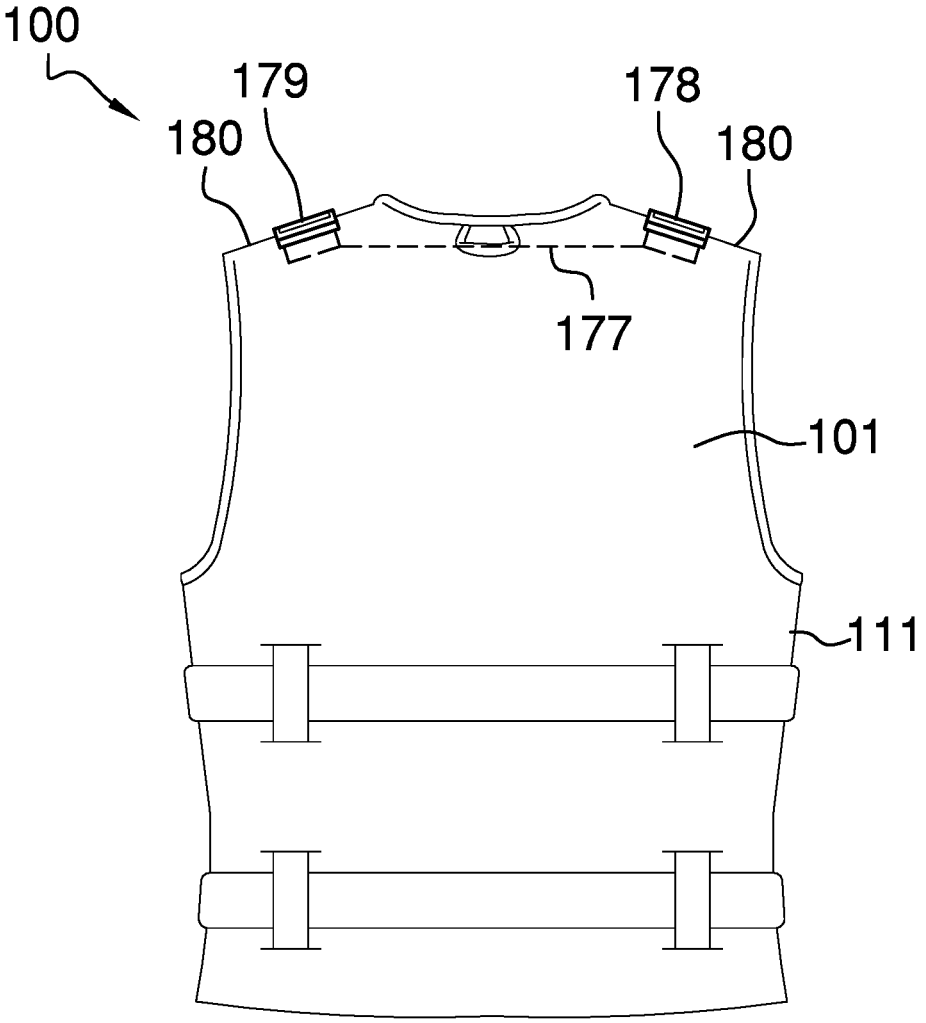
FIG. 3 is a back view of an embodiment of the disclosure.

Detailed reference will now be made to a plurality of potential embodiments of the disclosure, which are illustrated in FIGS. 1 through 5.

The lifesaving jacket with integrated EPIRB radio 100 (hereinafter invention) comprises a garment 104. The garment 104 is a personal safety device that is adapted for use by an individual. The garment 104 is designed to be worn during emergency situations. Should the individual wearing the garment 104 come into the distress during the emergency situation, the individual can manually activate a beacon 102 that is incorporated into the garment 104 such that a distress message including the GPS coordinates of the garment 104 is transmitted to the appropriate authorities indicating the need for assistance. By securely attaching the beacon 102 to the garment 104 and by constantly wearing the garment 104, an individual 500 has ready and immediate access to the beacon 102 for safety and rescue purposes.

The garment 104 further comprises a vest 101, the beacon 102, and a pocket 103. The vest 101 is a readily and commercially available garment into which the beacon 102 is inserted and stored. The vest 101 further comprises the pocket 103. The pocket 103 is an enclosed pouch that is integrated into the construction of the vest 101 such that the pocket 103 forms a chamber 118 to receive and store the beacon 102. In a situation of potential emergency, the vest 101 is worn around the torso in the normal manner of vests 101. Should an emergency arise that requires the sending of a distress message, the beacon 102 would be activated using a button 119 or other switch to send a distress message to the appropriate authorities.

In the second potential embodiment of the disclosure, the vest 101 is a commercially available personal flotation device 111, also known as a PFD.

The beacon 102 is a readily and commercially available tracking and messaging system. Suitable tracking and messaging systems include, but are not limited to, EPIRB based system and satellite messenger systems. In all the potential embodiments described in this disclosure, the use of EPIRB based systems is preferred.

The pocket 103 forms the chamber 118 within which the beacon 102 is received and stored. The pocket 103 further comprises a wall 115, a flap 116, and a fastener 117.

A first edge 161 of the wall 115 is attached to the vest 101. A second edge 162 of the wall 115 is attached to the vest 101. A third edge 163 of the wall 115 is attached to the vest 101. The first edge 161, the second edge 162, and the third edge 163 form the flap 116.

The wall 115 and the flap 116 of the pocket 103 is secured using a fastener 117. The purpose of the fastener 117 is to attach the flap 116 to the wall 115 such that the beacon 102 will be securely stored within the chamber 118. Fasteners suitable for use with pockets 103 are readily and commercially available and include, but are not limited to, zippers, snaps, buttons, buckles, one or more quick release buckles, or hook and loop fasteners.

To use the invention 100, the beacon 102 is placed in the chamber 118 of the pocket 103 and secured. In situations where a mesh textile was used for the wall 115, the beacon 102 is placed in the chamber 118 such that the controls of the beacon 102 are accessible through the mesh textile. The vest 101 is then worn by an individual continuously in an emergency situation such that the beacon 102 is continuously available to send a distress message.

As shown in FIG. 4, in a fifth potential embodiment of the disclosure, the pocket 103 is formed from the wall 115 which is installed on the vest 101 in a manner identical to that used in the first potential embodiment of the disclosure and the fastener is replaced with a zipper.

As shown in FIG. 4, in a fifth potential embodiment of the disclosure, the pocket 103 is formed from the wall 115 which is installed on the vest 101 in a manner identical to that used in the first potential embodiment of the disclosure and the fastener is replaced with a zipper.

As shown in FIG. 4, a sixth potential embodiment of the disclosure is identical to the fifth potential embodiment of the disclosure with the modification that the vest 101 is a commercially available personal flotation device 111.

The beacon 102 includes a first wire 177 that extends from within the chamber 118 to a first strobe member 178. Moreover, the first wire 177 extends from the first strobe member 178 over to a second strobe member 179. Both the first strobe member 178 and the second strobe member 179 are presented on a shoulder surface 180 of the vest 101. Both the first strobe member 178 and the second strobe member 179 emit a bright light when the beacon 102 is activated via the button 119 provided on an outer, front surface 181 of the vest 101.

The beacon 102 is a commercially available EPIRB with GPS capability, which when activated via the button 119 initiates a distress message, and operates the first strobe member 178 and the second strobe member 179. During an emergency scenario, an individual 500 wearing the invention 100 is able to float in a body of water 600 such that the first strobe member 178 and the second strobe member 179 are visible above said body of water 600.

The following definitions were used in this disclosure:

Buckle: As used in this disclosure, a buckle is a fastening that is used for joining a first loose end of a strap to a second loose end of the same strap or a different strap. A buckle further comprises a male connector that is attached to a first loose end and a female connector that is attached to a second loose end. The male connector has a pin or other structure that is generally caught by a structure formed in the female connector.

Drape: As used in this disclosure, to drape means to hang in a fabric with one or more freely hanging edges.

EPIRB: As used in this disclosure, EPIRB is an acronym for Emergency Position Indicating Radio Beacon. The EPIRB is a satellite based radio beacon that transmits a distress message indicating an emergency situation. In later version of EPIRBs, this distress message includes the GPS coordinates of the EPIRB. The EPIRB is primarily intended for use by sea vessels and is incorporated into the International Cospas-Sarsat search and rescue program. At the time of the filing of this disclosure, EPIRBs operated on a frequency of 406 MHz. Commercially available versions of EPIRBs are commonly marketed as Personal Location Beacons and Personal Rescue Beacons are which are referred to by the acronyms PLB and PRB respectively.

Fastener: As used in this disclosure, a fastener is a device that is used to join or affix two objects. Fasteners generally comprise a first part which is attached to the first object and a second part which is attached to the second object.

GPS: As used in this disclosure, depending on the context GPS refers to: 1) a system of navigational satellites that are used to determine the position and velocity of a person or object; 2) the system of navigational satellites referred to in the first definition that are used to synchronize to global time; or, 3) an electronic device or that uses the system of navigational satellites referred to in the first definition to determine the position of a person or object. GPS is an acronym for Global Positioning System.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

PFD: As used in this disclosure, PFD is an acronym for personal flotation device. A personal flotation device is safety equipment in the form of a garment or device that assists a person in remaining afloat in water.

Pocket: As used in this disclosure, a pocket is a small pouch that is formed into an object. Pockets are often formed by joining a second textile or a second sheeting to a first textile or a first sheeting, respectively, by sewing or heat sealing respectively.

Quick Release Buckle: As used in this disclosure, a quick release buckle is a specific type of buckle wherein the buckle can be readily and easily disconnected by pressing a button or pinching one of the ends of the quick release buckle. Quick release buckles are readily and commercially available.

Ring and Slider Arrangement: As used in this disclosure, a ring and slider arrangement is an apparatus comprising a ring component and a slider component that is used to adjust the effective length of a webbing in an application. In the ring and slider arrangement, an end of the webbing is inserted through the slider component, looped through the ring component and then reverse threaded through the slider component for a second time. By adjusting the position of the slider component relative to the webbing, the effective length of the webbing can be adjusted. Ring and slider arrangements are well known and documented in the textile arts.

Satellite Messenger System: As used in this disclosure, a satellite messenger system is a commercially available tracking and communication system that uses the GPS to track the position of the user and allow a user to access a satellite based system to send text messages, including distress messages, to search and rescue authorities or other interested safety personnel.

Sewn Seam: As used in this disclosure, a sewn seam a method of attaching two or more layers of textile, leather, or other material through the use of a thread, a yarn, or a cord that repeatedly inserted and looped through the two or more layers of textile, leather, or other material.

Strap: As used in this disclosure a strap is a strip of leather, cloth, or other flexible material, often with a buckle, that is used to fasten, secure, carry, or hold onto something.

Strip: As used in this disclosure, the term describes a long and narrow object of uniform thickness that appears thin relative to the length of the object. Strips are often rectangular in shape.

Textile: As used in this disclosure, a textile is a material that is woven, knitted, braided or felted. Synonyms in common usage for this definition include fabric and cloth.

Vest: As used in this disclosure, a vest is a sleeveless waist to hip length garment that is worn over the torso.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A safety device comprising:

a garment;

wherein the garment is adapted for use by an individual;

wherein the garment is worn during emergency situations;

wherein should the individual wearing the garment come into the distress during the emergency situation, the individual can manually activate a beacon that is incorporated into the garment;

wherein should the individual wearing the garment manually activate a beacon a distress message including the GPS coordinates of the garment is transmitted to the appropriate authority;

wherein the garment further comprises a vest, the beacon, and a pocket;

wherein the pocket is an enclosed pouch that is integrated into the construction of the vest;

wherein the pocket forms a chamber that receives and stores the beacon;

wherein the beacon further comprises a button;

wherein the beacon is manually activated while the beacon is stored in the pocket;

wherein the pocket further comprises a wall and a flap;

wherein the wall and the flap of the pocket is secured using a fastener;

wherein the fastener is selected form the group consisting of zippers, snaps, buttons, buckles, one or more quick release buckles, or hook and loop fasteners;

wherein the wall is formed from a mesh textile;

wherein the beacon is an EPIRB;

wherein the beacon further comprises a strobe;

wherein the strobe is further defined as a first strobe member and a second strobe member;

wherein the beacon includes a first wire that extends from within the chamber to the first strobe member.

2. The safety device according to claim 1 wherein the vest is a personal flotation device.

3. The safety device according to claim 2 wherein the beacon is selected from the group consisting of an EPIRB system or a satellite messenger system.

4. The safety device according to claim 3 wherein the beacon further comprises a strobe.

5. The safety device according to claim 1 wherein the vest is a personal flotation device.

6. The safety device according to claim 5 wherein the beacon is a satellite messenger;

wherein the beacon further comprises a strobe.

7. The safety device according to claim 6 wherein the vest is a personal flotation device.

8. The safety device according to claim 1 wherein the first wire extends from the first strobe member over to the second strobe member; wherein both the first strobe member and the second strobe member are presented on a shoulder surface of the vest; wherein both the first strobe member and the second strobe member emit a bright light when the beacon is activated via the button provided on an outer, front surface of the vest.

9. The safety device according to claim 8 wherein the beacon is a commercially available EPIRB with GPS capability, which when activated via the button initiates a distress message, and operates the first strobe member and the second strobe member; wherein during an emergency scenario, an individual that is adapted to be wearing vest is able to float in a body of water such that the first strobe member and the second strobe member are visible above said body of water.

* * * * *